US007775300B2

(12) United States Patent
Krollmann

(10) Patent No.: US 7,775,300 B2
(45) Date of Patent: Aug. 17, 2010

(54) EARTH DRILLING DEVICE

(75) Inventor: Karl Johannes Krollmann, Augsburg (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 4 days.

(21) Appl. No.: 12/078,401

(22) Filed: Mar. 31, 2008

(65) Prior Publication Data

US 2008/0245571 A1 Oct. 9, 2008

(30) Foreign Application Priority Data

Apr. 5, 2007 (EP) ..... 07007186

(51) Int. Cl.
*E21B 7/00* (2006.01)
*E21B 10/44* (2006.01)

(52) U.S. Cl. ..... 175/57; 175/323; 175/207; 175/211

(58) Field of Classification Search ..... 175/86, 175/323, 320, 207, 211
See application file for complete search history.

(56) References Cited

U.S. PATENT DOCUMENTS

| | | | | |
|---|---|---|---|---|
| 4,057,117 | A * | 11/1977 | Bermingham | 175/88 |
| 5,099,986 | A * | 3/1992 | Kuzub | 198/666 |
| 5,184,688 | A * | 2/1993 | Trevisnani | 175/321 |
| 6,272,755 | B1 * | 8/2001 | Mittlesteadt et al. | 30/249 |

FOREIGN PATENT DOCUMENTS

| | | | |
|---|---|---|---|
| DE | 201 01 657 | U1 | 4/2001 |
| JP | 57 00218 | A | 1/1982 |
| JP | 60-238516 | A | 11/1985 |
| JP | 06 257363 | A | 9/1994 |
| JP | 11-107661 | A | 4/1999 |
| JP | 11 200749 | A | 7/1999 |
| KR | 1020040095497 | A | 11/2004 |
| KR | 1020050054659 | A | 6/2005 |

* cited by examiner

*Primary Examiner*—Kenneth Thompson
*Assistant Examiner*—Yong-Suk Ro
(74) *Attorney, Agent, or Firm*—Jacobson Holman PLLC

(57) ABSTRACT

An earth drilling device includes an auger, an encasing tube that surrounds the auger, a rotary drive for driving at least the auger in a rotating manner about a drilling axis, and an ejecting device for discharging drill spoil from the auger. The ejecting device has a discharge duct for the drill spoil, and a mast element along which the auger can be moved together with the ejecting device. A device for changing the length of the discharge duct is provided.

12 Claims, 4 Drawing Sheets

EARTH DRILLING DEVICE

BACKGROUND OF THE INVENTION

1. Field of the Invention

The invention relates to an earth drilling device designed with an auger, an encasing tube which surrounds the auger, a rotary drive for driving at least the auger in a rotating manner about a drilling axis, an ejecting device for discharging drill spoil from the auger, wherein the ejecting device has a discharge duct for the drill spoil, and a mast element along which the auger can be moved together with the ejecting device.

2. Related Art

A device for cased earth drilling is known for instance from JP 60-238516A. In this known drilling device, an ejection opening is provided at the upper end of the encasing tube below the rotary drill drive, through which the drill spoil conveyed by the auger can emerge. From the ejection opening the drill spoil falls along the encasing tube next to the drill tube to the ground. Since the ejection of drill spoil takes place on a level with the rotary drive, a great height of drop is present especially at the beginning of the drilling when the rotary drive is still located at a large distance from the ground. Therefore, special safety measures may be required to prevent accidents caused by drill spoil being dropped. In addition, the largely uncontrolled ejection of drill spoil on a level with the rotary drive can lead to considerable pollution of the construction site.

A generic earth drilling device is known from JP 06-257363 A. In this drilling device a flexible discharge bag is provided at the ejection opening, which forms a discharge duct for the drill spoil and guides the drill spoil when dropping down. An undirected swirling around of ejected drill spoil is thereby prevented so that the risk of accidents is reduced and pollution of the construction site is counteracted.

The discharge bag known from JP 06-257363 is designed such that it reaches to just above ground level when the drilling tool is withdrawn completely. This brings about a comparatively great length so that in windy weather conditions the fabric bag can move in an undesired way and get entangled in the device. Moreover, especially in the case of greater drilling depths a clogging of the bag may occur in particular if the drill spoil is humid and adheres to the bag.

SUMMARY OF THE INVENTION

The object of the invention is to provide an earth drilling device, which ensures a particularly secure, clean and reliable discharge of drill spoil.

The object is solved in accordance with the invention by an earth drilling device having an auger, an encasing tube which surrounds the auger, a rotary drive for driving at least the auger in a rotating manner about a drilling axis, an ejecting device for discharging drill spoil from the auger, wherein the ejecting device has a discharge duct for the drill spoil, and a mast element along which the auger can be moved together with the ejecting device, wherein a device is provided for changing the length of the discharge duct.

The earth drilling device according to the invention is characterized in that a device for changing the length of the discharge duct is provided.

A fundamental idea of the invention can be seen in the fact that the discharge duct for the ejected drill spoil is provided in a length-adjustable manner. This renders it possible to adapt the length of the discharge duct to the actual drilling depth, i.e. to shorten the discharge duct during downward drilling, that is when the ejecting device is lowered to the ground together with the auger and/or the encasing tube, and to extend the discharge duct again during withdrawal. As a result, this ensures that the end-side outlet opening of the discharge duct is always located a bit above the ground, whereby prevention is made of the discharge duct resting on the ground during downward drilling. In this way a continuous removal of drill spoil from the discharge duct can be ensured even in great drilling depths, which in turn counteracts clogging of the discharge duct. According to this aspect of the invention the change of the length of the discharge duct is suitably accompanied by a change of the dimensions of the discharge duct longitudinally to the drilling axis, i.e. longitudinally to the mast element. Moreover, according to the invention the wind influence sensitivity is reduced because parts of the discharge duct that are not required temporarily can be telescoped so that the loads stemming from wind are decreased.

Basically, the discharge duct can be designed e.g. as a slide that is open on one side. However, for a particularly reliable guidance of the ejected drill spoil it is of advantage that the discharge duct is designed as a discharge tube. Through this an all-round guidance of the drill spoil is provided and an undesired swirling around of drill spoil is thereby prevented in an especially effective way.

A length change of the discharge duct can be effected for example in that additional elements are attached to or removed from the duct. If use is made of a flexible discharge duct, such as a fabric hose, the duct could be shortened e.g. through winding up or gathering. However, it is particularly advantageous for the discharge duct to be telescopic. If the discharge duct has a telescopic design the length change of the duct can be carried out in a particularly simple and reliable manner. A telescopic design of the discharge duct is of particular advantage if the discharge duct is to be designed in a rigid manner in order to reduce wind influence sensitivity.

It is especially advantageous for the discharge duct to have a plurality of tube elements which can preferably be telescoped in order to shorten the discharge duct. Through this a telescopic function can be realized in an especially simple way.

Furthermore, according to the invention it is advantageous for the tube elements to narrow towards an end portion. This renders it possible for the tube elements of the discharge duct to be provided, at least by approximation, with the same dimensions whilst realizing at the same time the telescopic function. The telescope-like retracting of adjacent tube elements into one another is ensured in this case by the narrowing portions of the tube elements. To allow for a particularly reliable guidance of the drill spoil the narrowing portions suitably run in such a way that the diameter of the tube elements decreases with an increasing distance to the rotary drive, i.e. normally towards the ground. If the tube elements are provided with narrowing portions the elements can if necessary also be referred to as a funnel on account of their shape, in which case the entire discharge duct can then be referred to as a funnel chain. Particularly, for an especially simple production the narrowing portions are suitably conical taperings. Apart from narrowing portions in the tube elements a telescopic function of the discharge duct can also be provided in that tube elements of different cross-sections are employed.

Another particularly preferred embodiment of the invention resides in the fact that the device for changing the length of the discharge duct has at least one hoisting cable and that, in addition, the device for changing the length of the discharge duct preferably has at least one winch device for changing the free length of the hoisting cable. As a result, a length adjustment of the discharge duct is rendered possible in an especially simple and reliable manner. More particularly, a hoisting cable operation is comparatively insensitive to distortions and deflections of the discharge duct which may occur for example due to wind load. Basically, e.g. a rack-and-pinion mechanism can also be provided for changing the length of the discharge duct. With regard to force absorption it is of advantage that several hoisting cables, e.g. two hoisting cables, are provided, which then can have an own winch device each.

From a constructional point of view an especially simple mechanism for changing the length of the discharge duct is given in that the hoisting cable is fixed to at least one of the tube elements. By preference, the hoisting cable is fixed to a tube element located at the end, i.e. in particular to a tube element arranged the furthest away from the rotary drive and/or the closest to the ground. In such case the discharge duct can be telescoped along its entire length, and during shortening the tube elements arranged in the end portion of the discharge duct, i.e. the lower tube elements located close to the ground, are telescoped first and gradually these elements take along the tube elements lying above. To increase the stability of the discharge duct it is of advantage that the remaining tube elements are each guided on the hoisting cable in a longitudinally movable manner. To this end, it is suitable for the tube elements to have guide openings, through which the hoisting cable is guided so that the tube elements can be moved freely along the hoisting cable. In this case the hoisting cable serves not only for holding a tube element but also for laterally stabilizing the remaining tube elements disposed above.

Additionally or alternatively, provision can be made for the hoisting cable to run through guides on the tube elements, and below these guides the hoisting cable has a respective engaging piece in the form of a cable rest. This renders it possible that the distances between the individual tube elements become shorter upon a decreasing of the free length of the hoisting cable and that the individual tube elements slide into one another.

With regard to the reliability of the earth drilling device according to the invention it is especially advantageous that means are provided that limit travel during the extension of adjacent tube elements. For this purpose e.g. stop elements can be provided on the tube elements which limit an axial relative movement of the individual tube elements with respect to one another. For example on the upper side of the tube elements a radially protruding stop element can be provided, which, on reaching maximum extension travel, comes to rest against a radially inward protruding stop element of the tube element lying above. However, it is particularly preferred that adjacent tube elements are each connected to one another by at least one retaining cable. By preference, the retaining cable is fixed thereby to the opposite lying ends or to the respective upper end of adjacent tube elements. It is particularly suitable for adjacent tube elements to be connected to one another by three retaining cables each, which are distributed equidistant along the periphery of the tube elements. By limiting the axial movement of adjacent tube elements, e.g. through retaining cables or stops, prevention can be made of undesired interspaces occurring during extension of the discharge duct between adjacent tube elements, from which drill spoil might emerge.

It is especially useful that the ejecting device has a collecting container which preferably surrounds the auger. The collecting container, which can have a cylindrical design in particular, suitably serves to receive drill spoil from the auger and to deliver it to the discharge duct. Preferably, the collecting container is arranged at the upper end of the encasing tube, i.e. at the end facing away from the ground, and/or at the underside of the rotary drive.

It is particularly advantageous for an ejecting chute to be provided on the collecting container for supplying drill spoil to the discharge duct. This allows for an especially reliable transfer of drill spoil from the collecting container to the discharge duct. To permit a gravity-based supply the ejecting chute is preferably directed away from the collecting container in the downward direction. For best suitability the ejecting chute ends above the uppermost tube element of the discharge duct so that drill spoil can be fed in a simple manner into the discharge duct.

For best suitability the encasing tube and the auger are provided in a rotating manner relative to the collecting container. To permit a passage of drill spoil from the auger to the collecting container at least one through-hole is suitably provided in the encasing tube on a level with the collecting container. The collecting container can have a closure device, by which a passage of drill spoil from the collecting container to the ejecting chute and/or to the discharge duct can be blocked selectively.

If the drill string with the auger and the encasing tube is drilled down to a large depth, the collecting container is normally located only just above the ground so that the discharge duct telescoped to minimal length would perhaps also rest on the ground and a controlled ejection of drill spoil would then be no longer possible. To prevent this in particular it is of advantage that a lifting device is provided, by means of which the discharge duct can be moved, in particular together with the winch device, relative to the rotary drive and/or the ejecting device for example in the direction of the drilling axis. More particularly, the lifting device renders it possible to lift the discharge duct in its entirety when the drill string is drilled down to a large depth and thereby prevent ground contact. If the drill string is drilled down to a large depth, provision can be made for the drill spoil to be no longer ejected via the discharge duct but discarded directly from the collecting container because in this case the dropping distance for the drill spoil is only comparatively short. For this purpose the discharge duct can be moved by means of the lifting device in the upward direction and/or perhaps also in the radial direction and/or in the circumferential direction so that drill spoil from the collecting container is no longer passed on to the discharge duct.

The lifting device suitably has a crane device, by which the discharge duct can be lifted and/or pivoted together with the winch device. By preference, the crane device is fixed to the collecting container, especially below the rotary drive.

Furthermore, in accordance with the invention it is advantageous that a control is provided which is adapted to set the length of the discharge duct as a function of the position of a feed drive for the auger and/or the ejecting device. According to this embodiment the length of the discharge duct, and therefore its dimension in the drilling direction, is adjusted automatically to the feed of the drill string and therefore to the position of the collecting container above the ground, whereby ground contact of the discharge duct is counteracted automatically. It is suitable for the discharge duct to extend at least approximately parallel to the drilling direction, i.e. at least approximately longitudinally to the mast element.

For best suitability the rotary drive is a twin-head rotary drive, by which both the auger and the encasing tube can be set into rotation, by preference independently of each other. To this end the rotary drive suitably has two separate drive units. The collecting container is appropriately arranged below the lower drive unit provided for driving the encasing tube.

The invention also relates to a method for producing a borehole in the ground with an earth drilling device in accordance with the invention, in which the auger is set into rotation about the drilling axis by means of the rotary drive and is moved together with the ejecting device in the direction of the drilling axis in the ground, and in doing so the length of the discharge duct is adapted in the direction of the drilling axis. By making use of the earth drilling device according to the invention the advantages set out in this connection can be realized.

BRIEF DESCRIPTION OF THE DRAWINGS

In the following the invention will be described in greater detail by way of preferred embodiments shown schematically in the accompanying drawings, wherein.

DETAILED DESCRIPTION OF THE PREFERRED EMBODIMENTS

FIGS. 1 to 4 show an embodiment of an earth drilling device according to the invention in different operating conditions.

Figure 1:
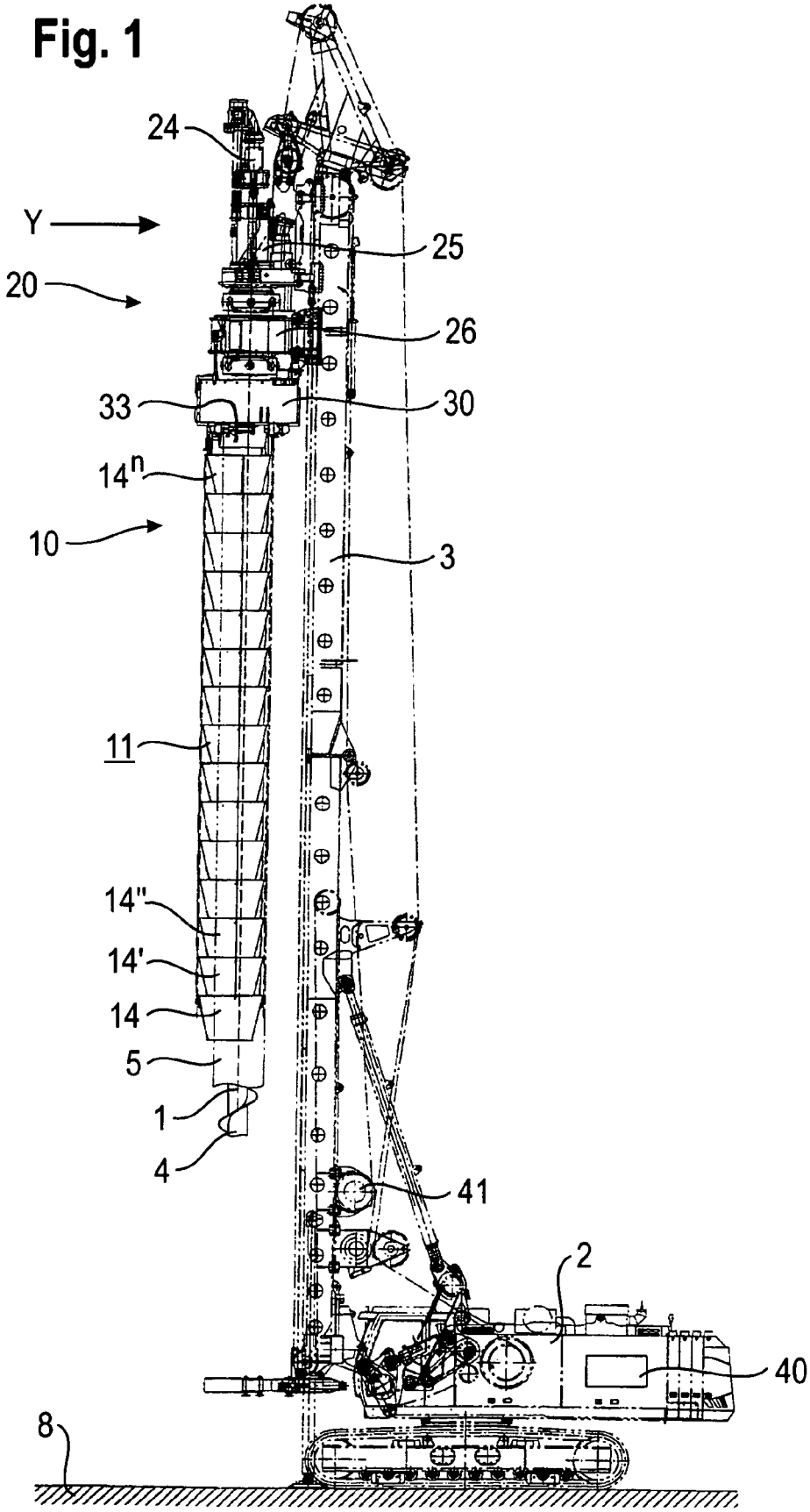
FIG. 1 shows a schematic side view of an embodiment of a drilling device according to the invention with extended discharge duct.

As shown in particular in FIG. 1, the earth drilling device has a running gear 2 designed as a crawler-type running gear, on which a mast element 3 extending at least approximately in the vertical direction is arranged. On the mast element 3 a rotary drive 20 is arranged in a longitudinally movable manner. The rotary drive 20 is designed as a twin-head drive. It has a first drive unit 24 for driving an auger 4 in a rotating manner and a second drive unit 25 for driving an encasing tube 5 in a rotating manner, in which case the encasing tube 5 surrounds the auger 4. The rotation of auger 4 and encasing tube 5 takes place about the drilling axis 1, respectively.

On the mast element 3 a feed drive 41 designed as a winch drive is provided, which is connected via a cable pull mechanism with the rotary drive 20. Through operation of the feed drive 41, the rotary drive 20 can be moved together with the auger 4 and the encasing tube 5 both arranged on the said rotary drive in the longitudinal direction of the mast element 3, that is in the direction of the drilling axis 1, so that the auger 4 and the encasing tube 5 can penetrate into the ground 8. During penetration of the ground 8 soil material is stripped by the auger 4 which is conveyed from the auger 4 inside the encasing tube 5 towards the rotary drive 20 in the upward direction. To discharge the stripped soil material from the auger 4 an ejecting device 10 is provided.

The ejecting device 10 has a collecting container 30. The said cylindrically designed collecting container 30 is arranged on the rotary drive 20 below the lower, second drive unit 25 of the rotary drive 20. The collecting container 30 surrounds the encasing tube 5 and the auger 4 arranged inside the latter. The said container serves to receive drill spoil that is conveyed during drilling operation from the auger 4 in the upward direction inside the encasing tube 5 in the direction of the drilling axis 1. In the part of the collecting container 30 the drill spoil is delivered through openings in the encasing tube 5 from the auger 4 into the collecting container 30.

Figure 4:
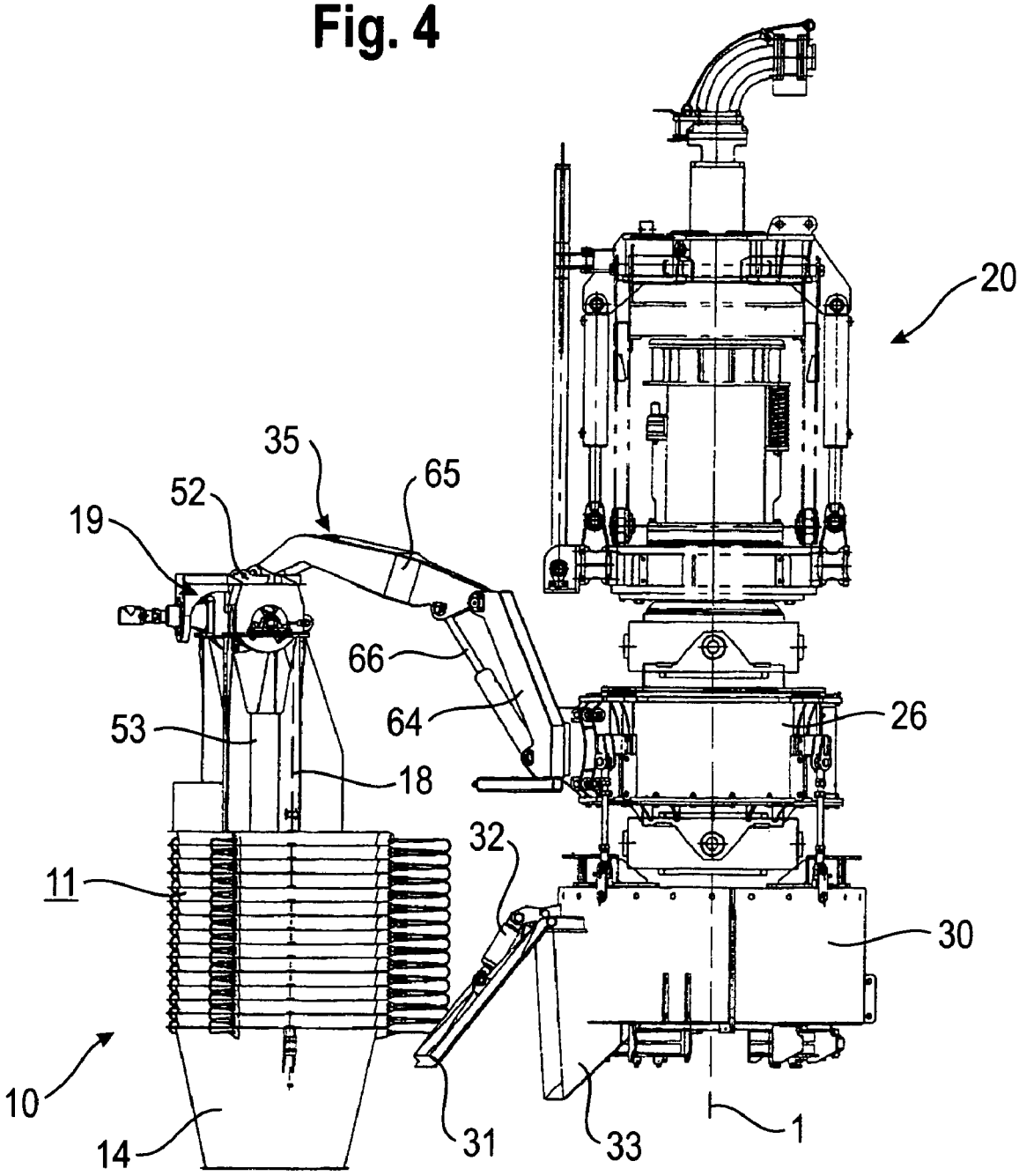
FIG. 4 shows a detailed view of the earth drilling device of FIG. 1 in the Y-direction with completely telescoped discharge duct, which is in addition moved away from the collecting container by means of a lifting device.

As can be seen in FIG. 4 in particular, an ejecting chute 33 is arranged on the collecting container 30 that extends radially towards the ground and by means of which drill spoil can be discharged from the collecting container 30 due to the effect of gravity. Moreover, as shown in particular in detail in FIG. 4, a flap 31 is provided on the ejecting chute 33 that can be operated by a drive 32 designed as a hydraulic cylinder. By means of this flap 31 the collecting container 30 can be closed and a conveyance of drill spoil via the ejecting chute 33 can be prevented thereby.

As depicted furthermore in FIGS. 1 to 4, the ejecting device 10 for the drill spoil moreover has a discharge duct 11. The discharge duct 11 extends longitudinally to the mast element 3 in the direction of the drilling axis 1 and is formed by a plurality of tube elements 14, 14', 14" to $\mathbf{14}^{n}$. All tube elements 14, 14', 14" . . . $\mathbf{14}^{n}$ substantially have the same dimensions and are designed conically with a narrowing towards the ground 8. As illustrated in particular in FIG. 3, the conical design renders it possible to slide the tube elements 14, 14', 14" to $\mathbf{14}^{n}$ telescopically into one another and to thereby reduce the length L of the discharge duct 11.

Figure 2:
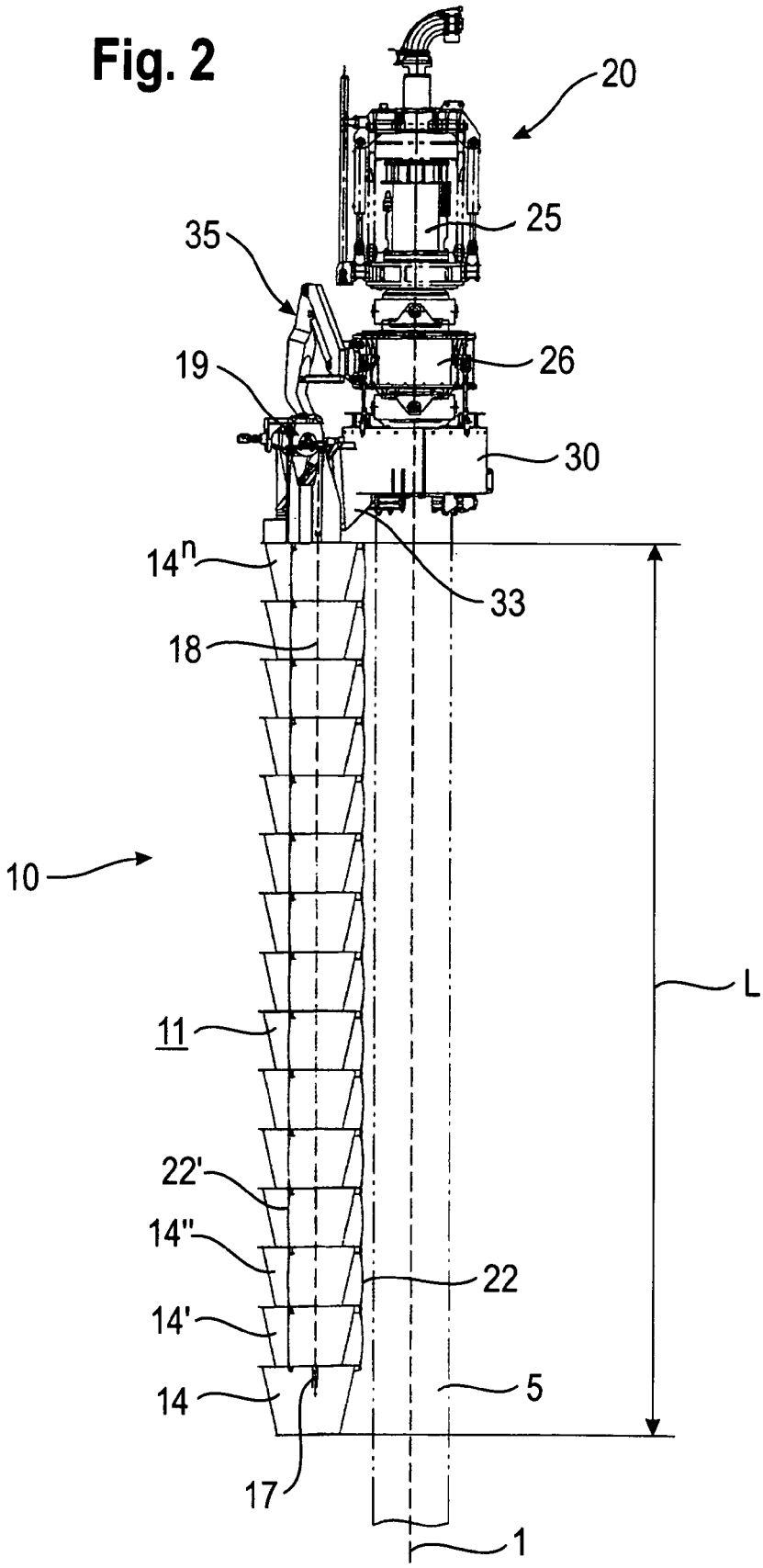
FIG. 2 shows a detailed view of the earth drilling device of FIG. 1 in the Y-direction with extended discharge duct.
Figure 3:
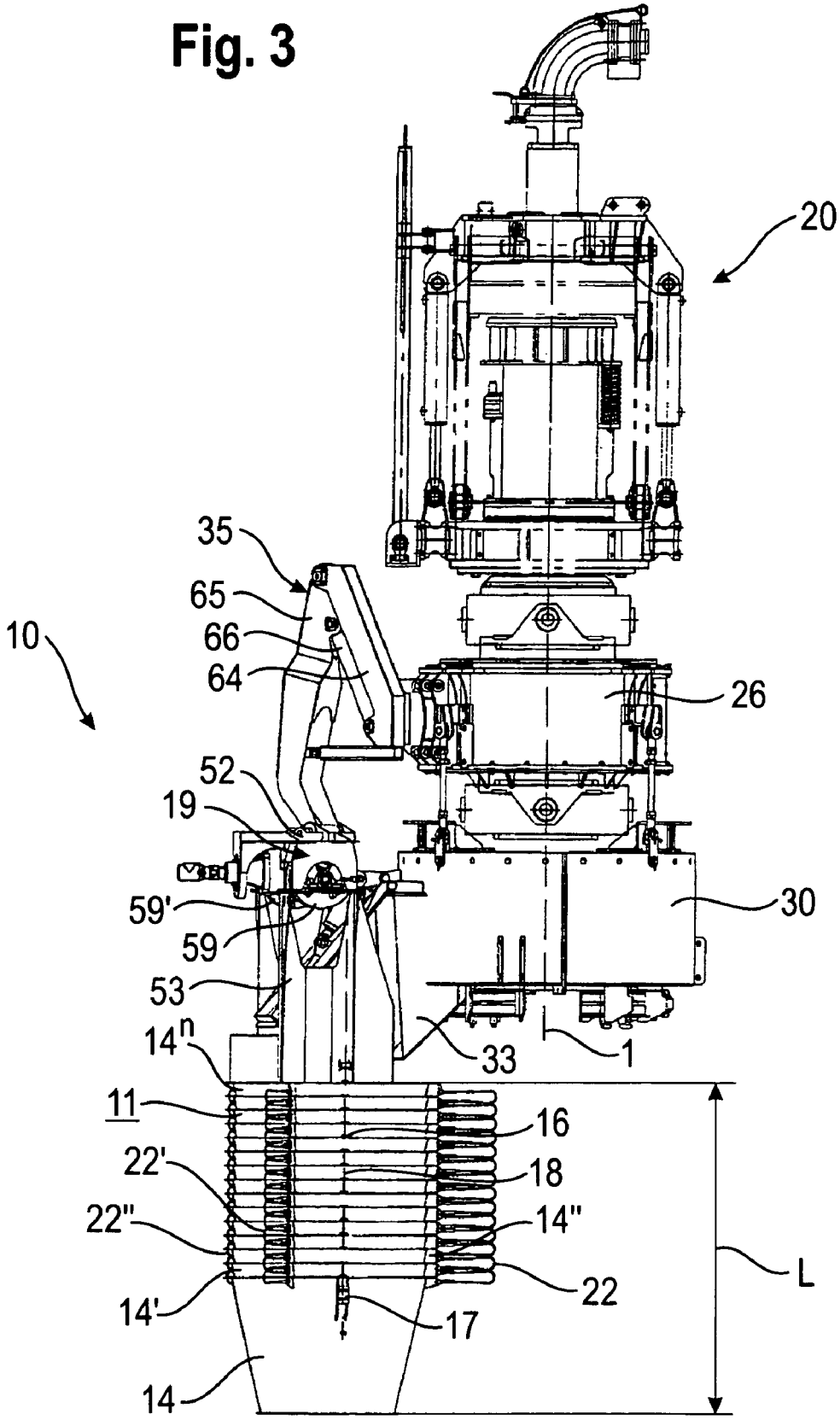
FIG. 3 shows a detailed view of the earth drilling device of FIG. 1 in the Y-direction with completely telescoped discharge duct.

As depicted especially in FIGS. 2 and 3, respectively adjacent tube elements $\mathbf{14}^{x}$, $\mathbf{14}^{x+1}$ are connected to one another by three retaining cables 22, 22', 22" that are arranged equidistant on the periphery of the tube elements $\mathbf{14}^{x}$, $\mathbf{14}^{x+1}$. The retaining cables 22, 22', 22" are each fixed to adjacent tube elements $\mathbf{14}^{x}$, $\mathbf{14}^{x+1}$ in an upper portion of them. The retaining cables 22, 22', 22" determine a maximum distance by which adjacent tube elements $\mathbf{14}^{x}$, $\mathbf{14}^{x+1}$ can be moved apart from one another and thereby ensure that the discharge duct 11 is not extended beyond the length shown in FIGS. 1 and 2. In this way the occurrence of interspaces between adjacent tube elements $\mathbf{14}^{x}$, $\mathbf{14}^{x+1}$ is prevented, through which drill spoil might emerge.

As illustrated furthermore in FIGS. 2 and 3, the ejecting device 10 has a hoisting cable 18 for length adjustment of the discharge duct 11. On its one end the hoisting cable 18 is fixedly connected by means of a retention device 17 to the lowermost tube element 14, i.e. to the tube element 14 located the farthest away from the collecting container 30. From there the hoisting cable 18 extends parallel to the drilling axis 1 in the upward direction. The tube elements 14' to $\mathbf{14}^{n}$ arranged above the lowermost tube element 14 are run through by the hoisting cable 18 in guide recesses 16 (cf. FIG. 3) so that the remaining tube elements 14' to $\mathbf{14}^{n}$ are stabilized laterally by the hoisting cable 18.

For operation of the hoisting cable 18 a winch device 19 is provided. As shown in particular in FIG. 3, the winch device 19 has a first winch 59 for the hoisting cable 18. In addition, a second winch 59' is provided. With this second winch 59' a second hoisting cable lying opposite to hoisting cable 18 is operated, which is obscured in the Figures and can therefore not be seen. The course and the fixing of this second hoisting cable are analogous to the first hoisting cable 18. Both hoisting cables therefore thread the tube elements 14, 14', 14" to $\mathbf{14}^{n}$ to a chain.

Moreover, as depicted in FIG. 3 in particular, the two winches 59, 59' are arranged on a crossbar 52 of a support device 53. Again, on this support device 53 the uppermost tube element $\mathbf{14}^{n}$ is fixed.

The winch device 19 permits a selective length change of the discharge duct 11. If the first hoisting cable 18 and the second hoisting cable not shown here are wound up by means of the winch device 19, the hoisting cables hoist the lowermost tube element 14. On its way upwards the lowermost tube element 14 successively takes along the remaining tube elements 14' 14" etc. until the discharge duct 11 is eventually telescoped completely, as depicted in FIG. 3.

For automatic operation of the winch device 19 a control 40 is provided, which sets the length L of the discharge duct 11 longitudinally of the drilling axis 1 as a function of the position of the feed drive 41 and therefore of the position of the auger 4 and the encasing tube 5.

As can be taken from FIGS. 3 and 4 in particular, the ejecting device 10 has a lifting device 35 designed as a crane. The said lifting device 35 is arranged on a frame 26 located between the rotary drive 20 and the collecting container 30, wherein the frame 26 is connected in a rotationally and axially fixed manner with the collecting container 30 and is run through by the auger 4 and the encasing tube 5. In principle, the lifting device 35 can however also be arranged on the lower drive unit 25 and/or on the collecting container 30. The lifting device 35 has two lever elements 64 and 65 that are connected to each other in an articulated manner. The first lever element 64 is arranged on the frame 26. On the second lever element 65 the discharge duct 11 is suspended via the crossbar 52 of the support device 53. The lifting device 35 has a drive 66 designed as a hydraulic cylinder, by which the second lever element 65 can be pivoted with respect to the first lever element 64. In doing so, the position of the discharge duct 11 suspended on the lifting device 35 is changed relative the collecting container 30 in the direction of the drilling axis 1 as well as radially thereto. In particular, the lifting device 35 permits movement of the discharge duct 11 from the position shown in FIG. 3 below the ejecting chute 33 to the position shown in FIG. 4, in which the discharge duct 11 is lifted and spaced radially with respect to the ejecting chute 33 so that drill spoil can fall from the ejecting chute 33 directly to the ground.

The drilling device shown in FIGS. 1 to 4 can be operated as follows:

At the beginning of the drilling operation the encasing tube 5 and the auger 4 are located over-ground 8 and the discharge duct 11 is extended completely, as illustrated in FIGS. 1 and 2. Then the feed drive 41 is operated causing the auger 4 and the encasing tube 5 to be drilled into the ground 8. Any drill spoil resulting from this is conveyed by the auger 4 inside the encasing tube 5 in the upward direction where it is delivered to the collecting container 30. From the collecting container 30 the drill spoil is passed via the ejecting chute 33 into the discharge duct 11 wherein it falls to the ground in a controlled manner.

During introduction of the auger 4 with the encasing tube 5 into the ground the collecting container 30 as well as the discharge duct 11, which are fixed to the upper side of the encasing tube 5, are lowered, too. To prevent the discharge duct 11 from resting on the ground 8 during lowering the length L of the discharge duct 11 is reduced with an increasing drilling depth by means of the control 40. To this end the control 40 operates the winch device 19, which in turn causes the tube elements 14, 14', 14" to 14‴ to be hoisted by the hoisting cable 18, starting with the lowermost tube element.

Upon an increasing drilling depth the single tube elements 14, 14', 14" to 14‴ are telescoped more and more so that eventually the discharge duct 11 reaches the minimum length as set in FIG. 3.

In order to prevent the discharge duct 11 from resting on the ground 8 due to its remaining length during continued downward drilling, the duct 11 is subsequently lifted in its entirety by the lifting device 35 and moved away from the ejecting chute 33, as shown in FIG. 4. The drill spoil is then conveyed from the ejecting chute 33 directly to the ground.

The invention, which has been described by way of example in conjunction with vertical drilling can also be applied to inclined drilling and basically also to horizontal drilling, in which case an arrangement on the upper side can be understood as an arrangement facing away from the drilling ground.

The invention claimed is:

1. Earth drilling device comprising:

an auger, a rotary drive for driving at least the auger in a rotating about a drilling axis, an encasing tube which surrounds the auger, for conveying therethrough drill spoil stripped by the auger towards the rotary drive in the upward direction, an ejecting device for discharging the drill spoil conveyed upwardly through the encasing tube by the auger, wherein the ejecting device has an upper end arranged at the upper end of the encasing tube and a discharge duct of adjustable length along a vertical axis parallel to the drilling axis and constructed for receiving the drill spoil conveyed upwardly through the encasing tube by the auger and guiding the drill spoil to the ground, wherein the discharge duct is movable relative to the upper end of the ejecting device, a mast element, along which the auger is movable together with the ejecting device, a device for changing the length of the discharge duct, and a lifting device for moving the discharge duct relative to the upper end of the ejecting device.

2. Earth drilling device according to claim 1, wherein the discharge duct is designed as a discharge pipe.

3. Earth drilling device according to claim 1, wherein the discharge duct is telescopic.

4. Earth drilling device according to claim 1, wherein the device for changing the length of the discharge duct includes at least one hoisting cable and at least one winch device for changing the free length of the hoisting cable.

5. Earth drilling device according to claim 4, wherein the discharge duct has a plurality of tube elements, the tube elements are telescopable for shortening the discharge duct, the tube elements narrow towards an end portion thereof, and the hoisting cable is fixed to at least one of the tube elements.

6. Earth drilling device according to claim 5, wherein the hoisting cable is fixed to a tube element located at the end of the discharge duct.

7. Earth drilling device according to claim 1, wherein the lifting device moves the discharge duct together with the winch device.

8. Earth drilling device according to claim 1, wherein the discharge ducts is also movable relative to the rotary drive, and wherein the lifting device also moves the discharge duct relative to the rotary drive.

9. Earth drilling device comprising:

an auger, an encasing tube which surrounds the auger, a rotary drive for driving at least the auger in a rotating manner about a drilling axis, an ejecting device for discharging drill spoil conveyed upwardly through the encasing tube by the auger, wherein the ejecting device has a discharge duct of adjustable length constructed for receiving the drill spoil conveyed upwardly through the encasing tube by the auger and guiding the drill spoil to the ground, wherein the discharge duct has a plurality of tube elements, wherein the tube elements are telescopable for shortening the discharge duct, and wherein the tube elements narrow towards an end portion thereof, and wherein adjacent tube elements are each connected to one another by at least one retaining cable, a mast element, along which the auger is movable together with the ejecting device, and a device for changing the length of the discharge duct.

10. Earth drilling device according to claim 9, wherein the ejecting device includes a collecting container which surrounds the auger, and an ejecting chute provided on the collecting container for supplying drill spoil to the discharge duct.

11. Earth drilling device according to claim 9, further comprising:

a control for setting the length of the discharge duct as a function of the position of a feed drive for the auger and the ejecting device.

12. Method for producing a borehole in the ground with an earth drilling device according to claim 9, comprising the steps of:

setting the auger in rotation about the drilling axis by means of the rotary drive and moving the auger together with the ejecting device in the direction of the drilling axis in the ground, so as to adapt the length of the discharge duct in the direction of the drilling axis.

* * * * *